United States Patent [19]

Larson

[11] Patent Number: 4,961,504

[45] Date of Patent: Oct. 9, 1990

[54] DOUBLE STRENGTH PEGBAR

[75] Inventor: Merle A. Larson, Leon Township, Goodhue County, Minn.

[73] Assignee: Cannon Equipment Company, Cannon Falls, Minn.

[21] Appl. No.: 94,168

[22] Filed: Sep. 8, 1987

[51] Int. Cl.[5] ..... A47F 7/00

[52] U.S. Cl. ..... 211/59.1; 248/220.4; 248/222.3

[58] Field of Search ..... 211/59.1, 54.1, 57.1; 248/220.4, 222.3

[56] References Cited

U.S. PATENT DOCUMENTS

| | | | |
|---|---|---|---|
| 3,200,960 | 8/1965 | Banse | 248/220.4 X |
| 3,638,801 | 2/1972 | Larson | 211/59.1 X |
| 3,986,613 | 10/1976 | Mayer | 211/57.1 |
| 4,606,466 | 8/1986 | Fredrickson | 211/59.1 |
| 4,610,413 | 9/1986 | Pedersen | 248/220.3 |

*Primary Examiner*—David M. Purol
*Assistant Examiner*—Sarah A. Lechok
*Attorney, Agent, or Firm*—Henry C. Kovar

[57] ABSTRACT

An improved pegbar has a double strength peg mounted therein. The new and improved peg for the pegbar has a generally U-shaped configuration with a pair of elongate adjacent bodies extending from a common front nose, and a key on the back end of each body. The nose is twisted ¼ turn to rotate the keys from a normal lock to an unlocked position. Methods of making and using the double strength peg are presented.

16 Claims, 1 Drawing Sheet

DOUBLE STRENGTH PEGBAR

BACKGROUND OF THE INVENTION

1. Field of the Invention

This invention pertains to a pegbar type display device, of the type commonly used for presentation and display of meat, cheese, and blister packaged small goods in retailing establishments.

2. The Prior Art

Pegbars display devices are well known and commonly used. They are found in most retailing establishments and virtually every person has purchased something off of a pegbar display.

Typical goods displayed on and purchased from pegbar displays are pre-packaged meat, cheese, batteries, film, tools, car parts, toys and so on.

Gerald D. Pedersen U.S. Pat. No. 4610413 provides a pegbar device which is a direct predecessor of this invention and has a pegbar with spaced apart keyholes, and a single strength cantilevered peg with a ¼ turn lock structure at the rear. This particular lock structure is utilized in this invention as will be described.

Howard J. Frederickson U.S. Pat. No. 4606466 utilized the Pedersen device and provided for structure for presenting graphic information and identification, specifically a sign and a sign holder.

The inventions of Pedersen and Frederickson work very well and are in extensive and growing commercially successful use.

The Pedersen and Frederickson inventions are available from Cannon Equipment Co., Cannon Falls, Minn. 55009 and are sold under the trademarks "MAGNA-BAR" and "TWIST 'N PULL".

Now, the entities that display goods want to provide deeper displays, present and display larger and heavier packages, and present new and heavier goods on pegbar displays.

The pegs of the Pedersen invention have been available and are successful in usable display lengths of 10, 12 or 15 inches. The goods merchandising people now want pegs approaching the length of a persons arm, for example pegs that are 20 to 24 inches long. The closed section cross bar of Pedersen's invention, is fully capable of carrying longer pegs and/or more weight without beam or torsional bending.

OBJECTS OF THE INVENTION

It is an object of the present invention to provide a stronger pegbar display device.

It is an object of the present invention to provide a pegbar display device that will support and display heavier goods and with longer pegs.

It is an object of the present invention to provide a double strength pegbar.

It is an object of the present invention to provide a stronger peg for a pegbar.

It is an object of the present invention to provide a double strength peg for a pegbar.

It is an object of the present invention to provide a new and stronger peg made by a unique process.

It is an object of the present invention to provide a method of securing a stronger peg in a pegbar.

It is an object of the present invention to provide a method of quick turn installation and/or removal of a peg to a pegbar.

It is an object of the present invention to provide a new method of making a new stronger peg for a pegbar.

SUMMARY OF THE INVENTION

A pegbar for presenting goods has a peg support bar with keyholes spaced from each other, a generally U-shaped double strength wire peg having first and second generally parallel elongate bodies for support of goods, discrete and generally identical keys on a back end of each body, the keys are simultaneously inserted in the keyholes and a nose of the peg is twisted to turn the keys enabling entry of the keys into the keyholes, when the nose is released, the keys lock the peg in and to the keyholes with discrete securement and support of each peg body.

A double strength wire peg for a pegbar has first and second elongate bodies for support of goods, a common front nose to which the bodies are adjacent, a discrete key on the back of each body, in which both keys are simultaneously rotatable by twisting the nose with respect to the keys.

A double strength peg for a pegbar made by the steps of forming a generally U-shaped wire peg having elongate bodies side by side forming a common nose on a front end of the bodies, and forming a substantially identical rotatable key on the back end of each body, each key having locking structure the same distance from the nose.

A method of securing double strength pegs in a peg support bar has the step of providing a support bar with spaced apart keyholes, providing a generally U-shaped wire support peg having a common nose connecting two elongate bodies with a rotatable locking key on the back of each body, grasping the nose and twisting it with respect to the keys and thereby turning both keys from a locked to an unlocked position, inserting the turned keys into the keyholes, and releasing the nose after the keys are inserted and allowing the keys to rotate to the locked position thereby locking the peg in the bar.

A method of making a double strength peg for a pegbar has the steps of forming a generally U-shaped wire peg having elongate side by side bodies, forming a common front nose between the bodies, and forming substantially identical rotatable locking key on a back end of each body.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
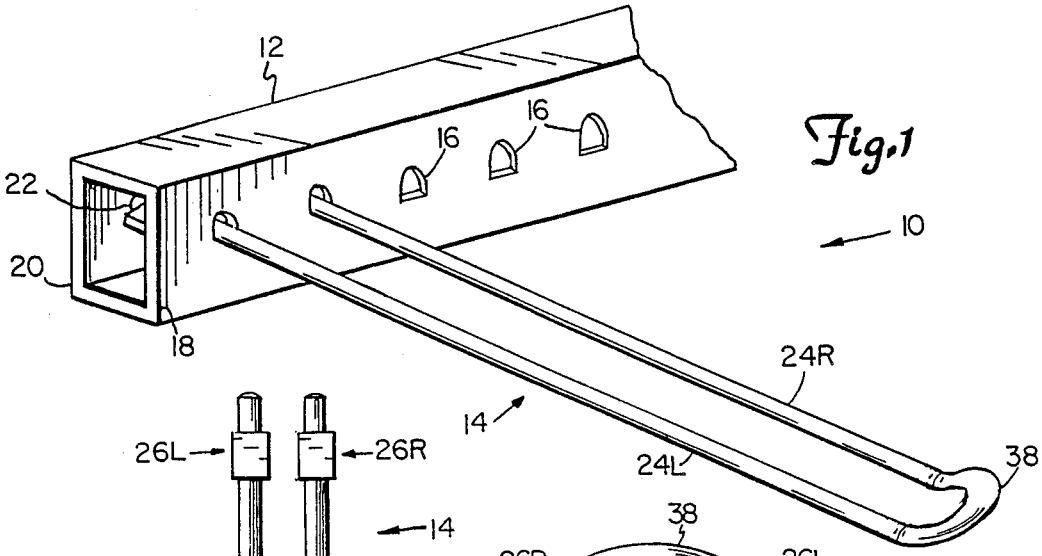
FIG. 1 is a perspective view looking down and from the left end of the preferred embodiment of a pegbar according to the present invention.

The preferred embodiment of a double strength pegbar is shown in FIG. 1 and generally indicated by the numeral 10. The pegbar !0 has a support bar 12 to which is removably mounted an increased strength peg generally indicated by the numeral !4.

Figure 3:
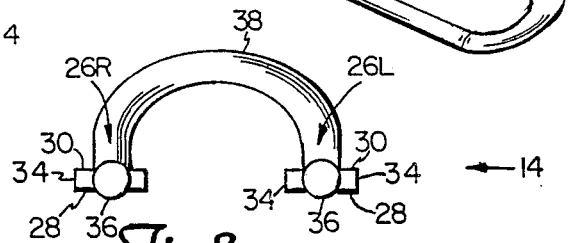
FIG. 3 is an elevational end view of the back of the peg in the normal position.
Figure 4:
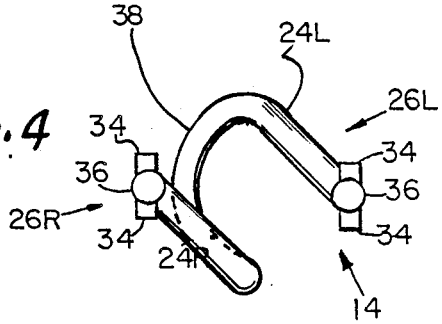
FIG. 4 is an elevational end view as in FIG. 3 with the nose of the peg twisted and the peg locks turned into the alternate unlocked position.
Figure 5:
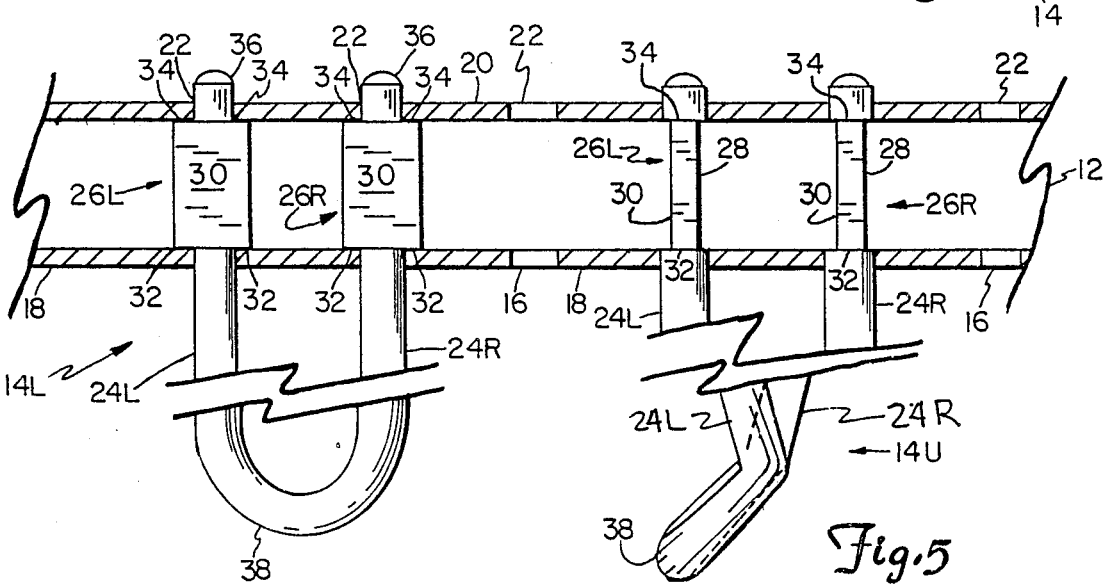
FIG. 5 is a top plan view with the bar in section, illustrating a peg locked in place, and an unlocked peg after insertion or ready for removal.

The support bar 12 is a tubular metal member having a plurality of non-round keyholes 16 which are spaced from each other in a line along the length of the front member of bar 12. Behind each keyhole 16 and in the rear member 20 of the tube forming the bar 12 is a backbore 22. Each keyhole 16 is preferably taller than it is wide whereas the backbores 22 are round. Each keyhole 16 preferably has a flat bottom and a rounded top and has a D-shape turned 90 degrees. This bar 12 is well known, and it and the keyhole 16 and backbore 22 structure are more fully and completely discussed in commonly owned U.S. Pat. No. 4,610,413 incorporated herein by reference. Reference is particularly made to FIGS. 3–5 of that patent.

Figure 2:
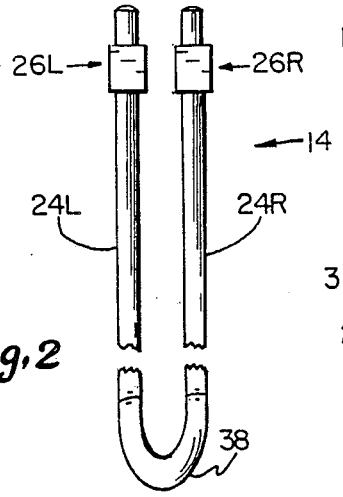
FIG. 2 is a top plan view of the preferred embodiment of the peg of the invention.

The peg 14 of the present invention is best shown in FIGS. 2–5. The peg 14, as clearly seen in FIG. 2, is in a generally U-shaped configuration with there being a pair of elongate and generally parallel and co-planar bodies 24L, 24R which are both adjoined to a common nose 38 which is preferably upturned. The entire U-shaped peg 14 is preferably made of a single length of wire, although it could be an assembly of sub-components. At the back end of each body 24L, 24R is a locking flat 26L, 26R which herein after will simply be referred to the key 26L, 26R. The keys 26L, 26R are substantially identical and have lower flats 28 and upper flats 30 which are co-planar from key 26L to key 26R. To the front of the flats 28, 30 are front abutments 32 and to the rear of the flats 28, 30 are rear abutments 34. Behind the rear abutments 34 are round toes 36 which are coaxial with the respective bodies 24L, 24R.

The structure of the keys 26L, 26R and their relationship to the keyholes 16 and backbores 22 is more fully and completely explained in U.S. Pat. No. 4,610,413. U.S. Pat. No. 4,606,466 is also referenced herein and can be referred to by the reader. However, it will become apparent that with this invention a keyform and keyhole profile different from that taught in U.S. Pat. Nos. 4,610,413 and 4,606,466 can also be utilized.

The spacing between the bodies 24L, 24R and the keys 26L, 26R is essentially the same as the spacing between adjacent keyholes 16. A peg 14 is shown inserted and locked into the bar 12 in the left side of FIG. 5. The keys 26L, 26R have been inserted into and through adjacent keyholes 16 and the toes 36 have been inserted into the appropriate backbores 22. The front abutments 32 engage the inside of the bar front member 18 and prevent forward movement of the peg 14, and the rear abutments 34 engage the inside of the bar rear member 20 and prevent rearward movement of the peg 14. Both keys 26L, 26R are equally locked in the bar 12 and therefore both bodies 24L, 24R are equally locked in and to the bar 12 in a supporting relationship.

We now have a peg 14 that has double the strength of the single peg shown in U.S. Pat. Nos. 4,610,413 and 4,606,466 and the load can now be doubled and/or the effective and usable length of the peg 14 can be extended.

So, now how do we get this double bodied peg 14 in and out of the bar 12? It's simple! All we do is manually grasp the nose 38 with our thumb and forefinger and turn or twist it 90 degrees or ¼ turn, and either pull the peg 14 out or insert it, as the case may be.

As the nose 38 is turned, the entire peg 14 lozenges and the keys 26L, 26R rotate 90 degrees or ¼ turn to the positions shown in FIG. 4 and the right side of FIG. 5 In this position the keys 26L, 26R are both unlocked and may be either inserted or removed from the bar 12 through the keyholes 16. The keys 26L, 26R are unlocked because the transverse distance across the flats 32, 34 is less than the height of the keyholes 16. Turning the peg nose 38 is relatively easy, any slight person can do it without tools. When the peg 14 is to be installed, the toes 36 are pushed into adjacent keyholes 16, the nose 38 is turned and the keys 26L, 26R are thereby turned, the keys 26L, 26R are pushed inside of the bar 12 and the nose 38 is released. The peq 14 resiliently returns to its normal configuration and resiliently biases the keys 26L, 26R into the locked position. When a goods (not shown) is hung upon both of the bodies 24L, 26R, the nose 38 can not be twisted without moving the goods around. To remove the peg 14, the nose 38 is twisted and the keys 26L, 26R are thereby turned, and the peg 14 is merely pulled straight out and away from the bar 12. The peg 14 goes straight into the bar 12 during installation.

The new peg 14 is extremely enhancing for efficient manufacture and quality control. A single length of round wire is formed into the general U-shape and the nose 38 is upturned if desired, and the two keys 26L, 26R are formed by a single hit of a hammer die across the rear of the bodies 24L, 24R. The keys 26L, 26R are then exactly the same and exactly the same distance from the nose 38.

It is to be emphasized that the keyholes 16 and keys 26L, 26R could be arbitrarily turned in this invention, but the preferred peg turned in this invention, but the preferred peg 4 is devised to retrofit into a bar 12 which is according to U.S. Pat. No. 4,610,413. The peg can also be configured so that it is triangulated and the keys 26 are locked to keyholes 16 which are spaced above each other, either in two bars 12 or in a vertically enlarged single bar with parallel rows of keyholes 16 (not shown).

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A pegbar for presenting goods, said pegbar comprising (a) a peg support bar having at least two keyholes, said keyholes being spaced from each other;

(b) a generally U-shaped double strength wire peg having first and second elongate bodies defining a horizontal plane for jointly supporting goods thereon, said bodies extending rearward and generally side by side from a common front nose;

(c) discrete and generally identical key means on a back end of each body for discrete and simultaneous supporting securement of both bodies in said keyholes with one key means being in each keyhole, each key means having key structure on a common axis with said horizontal plane for being locked in a respective keyhole, said key structures being simultaneously rotatable about their respective axis in a respective keyhole from a normal locking position to an alternative unlocked position for insertion or removal; and in which (d) said key means are simultaneously insertable straight into said support bar and are simultaneously removable straight from said support bar while said peg remains generally horizontal by twisting said nose with respect to said key means, thereby simultaneously and equally rotating both key structures about their respective axis from the locking position to the unlocked position while the peg remains generally horizontal.

2. A pegbar according to claim 1, in which said key structure and said keyholes have structure providing for ¼ turn lock or unlock.

3. A pegbar according to claim 1, in which there is a pilot toe on the back side of each key means, said pilot toes being simultaneously rotatable about their respective axis in said support bar in response to twisting of the nose.

4. A pegbar according to claim 1, in which both of said key structure have generally identical abutments for discretely locking both bodies in the support.

5. A peg according to claim 1, in which said nose of said resiliently biases said key means to the locking position.

6. A pegbar according to claim 1, including a round pilot toe to the rear of each key means.

7. A pegbar according to claim 6, in which said abutments are coplanar.

8. A peg according to claim 1, in which said key structure are ¼ turn keys, and in which said peg is structured so that said keys can be simultaneously and discretely rotated ¼ turn by twisting said nose.

9. A pegbar according to claim 1, in which said bodies, nose and key means are all formed of a single length of wire.

10. A method of securing a double strength peg in a peg support bar comprising the steps of (a) providing a peg support bar having a plurality of spaced apart keyholes thereon;

(b) providing a generally U-shaped wire support peg having a common nose, two elongate wire bodies defining a horizontal plane extending side by side and rearward from the nose, and a discrete rotatable locking key on the back of each body, each body and key being on a respective common axis;

(c) grasping the nose and twisting it with respect to the keys and thereby simultaneously turning both keys in said horizontal plane about their respective axis from a locked position to an alternative unlocked position;

(d) inserting the turned keys into a respective pair of keyholes while the nose is so twisted; and (e) releasing the nose after the keys are inserted into the keyholes and thereby rotating both keys about their respective axis back to the locked position and discretely locking both bodies of the peg in the support bar.

11. A method according to claim 10, in which a toe has been formed, on a backside of each key, each key backside being formed on identical distance from the nose.

12. The method according to claim 10, in which each body is cantilevered from the common nose.

13. A method according to claim 10, including the further step of resiliently biasing said keys about their respective axis and into the locked position with the nose.

14. A method according to claim 10 in which the peg includes a discrete toe on the back of each key, and including the further step of piloting both keys in respective keyholes during twisting of the nose.

15. A method according to claim 10, including the further step of hanging a single goods on both bodies, and preventing accidental twisting of the nose during display of goods on the double strength peg.

16. A method according to claim 10, including the step of twisting the nose ¼ turn, and turning both keys ¼ turn about their respective axis.

* * * * *